US006945143B2

(12) United States Patent
Kim

(10) Patent No.: US 6,945,143 B2
(45) Date of Patent: Sep. 20, 2005

(54) SELF-ADJUSTABLE UNIVERSAL SPANNER

(76) Inventor: Kwang-Moo Kim, #85-220 Ah Hyun Dong, Ma Po Ku, Seoul (KR)

( * ) Notice: Subject to any disclaimer, the term of this patent is extended or adjusted under 35 U.S.C. 154(b) by 0 days.

(21) Appl. No.: 10/795,314

(22) Filed: Mar. 9, 2004

(65) Prior Publication Data

US 2004/0221693 A1 Nov. 11, 2004

(30) Foreign Application Priority Data

May 6, 2003 (KR) ..... 10-2003-0028700

(51) Int. Cl.[7] ..... B25B 13/12
(52) U.S. Cl. ..... 81/179; 81/58.2
(58) Field of Search ..... 81/179, 58.2

(56) References Cited

U.S. PATENT DOCUMENTS 1,308,440 A * 7/1919 Morrison ..... 81/179
2,855,814 A * 10/1958 Yavner ..... 81/179
2,879,681 A * 3/1959 Blasdell ..... 81/179
3,023,654 A * 3/1962 Stambaugh et al. ..... 81/179
3,717,054 A * 2/1973 Thompson ..... 81/179
3,858,467 A * 1/1975 Evans ..... 81/179
5,533,428 A * 7/1996 Pradelski ..... 81/179
5,579,667 A 12/1996 Kim
5,768,958 A * 6/1998 Gamble ..... 81/58.2
6,202,516 B1 3/2001 Kim

* cited by examiner

*Primary Examiner*—David B. Thomas

(57) ABSTRACT

The present invention relates to a self-adjustable universal spanner comprising: a spanner head member having a jaw for seating a bolt head and a feed groove. The jaw includes a flat contact surface which is in surface contact with the flat surface of the bolt head in the front lower of the jaw, and includes an escape curved surface and a slope surface for vertex contact in the rear of the flat contact surface. The feed groove includes a spring insert groove with a pin escape groove being installed in the rear thereof and a guide groove for deviation prevention with an escape slope contact surface, a slope surface for slip prevention, a guide protrusion and a elastic support pin. The slope contact surface is formed in the top of the member, and the contact surface for slip prevention is formed in the rear bottom of the flat contact surface. The guide protrusion has a deviation preventing shoulder protrusively installed in the length direction, and the support pin is provided in the rear of the member, wherein the member is slidably inserted in the feed groove means of the spanner head; and a deviation preventing pin keeps the brake piece member from deviating by being inserted in front of the guide groove for deviation prevention. Therefore, the present invention may fasten or loosen a bolt or nut simply, continuously and efficiently without the spanner head being deviated from the bolt or nut.

12 Claims, 6 Drawing Sheets

[Fig1]
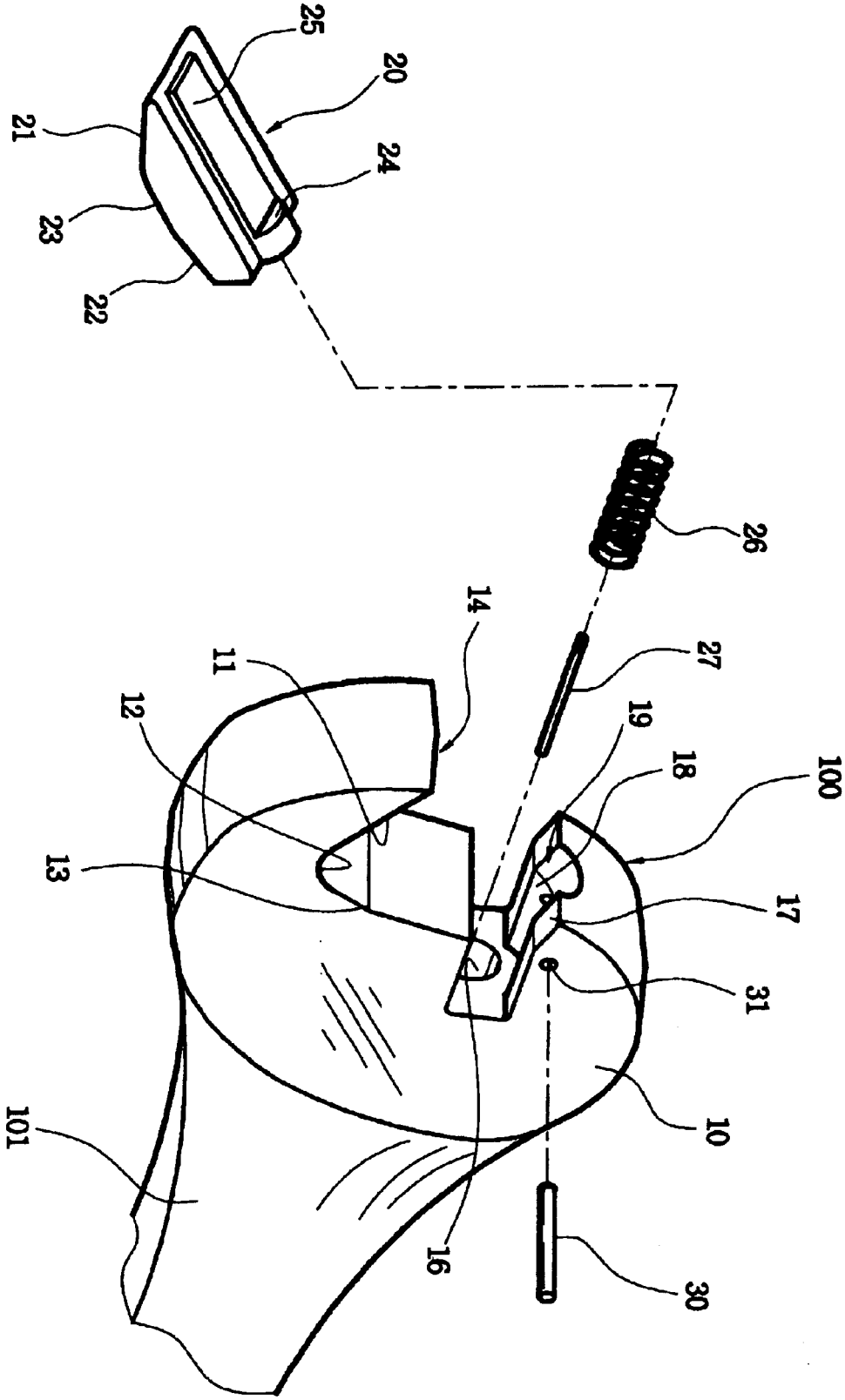

[Fig2]
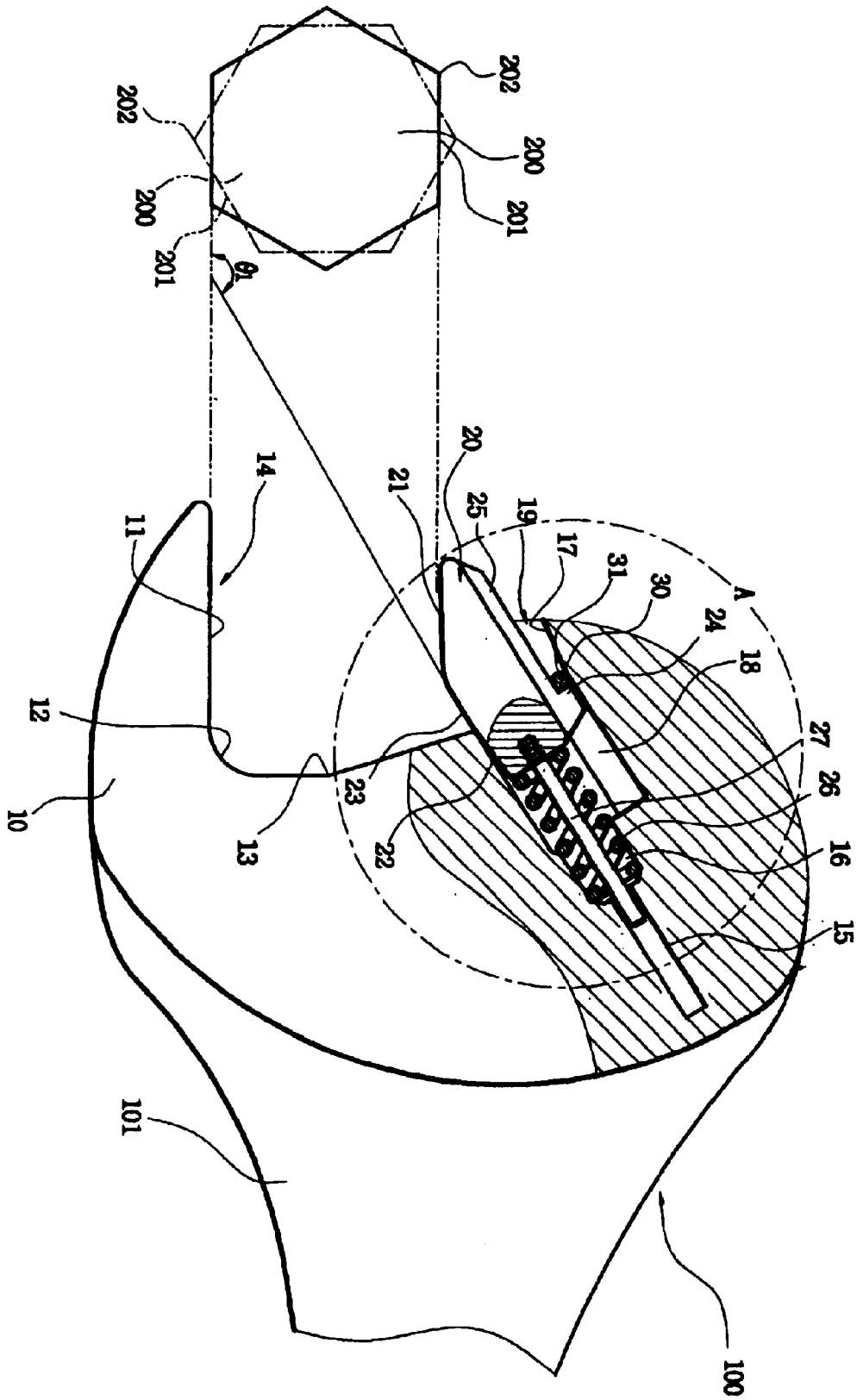

[Fig3]
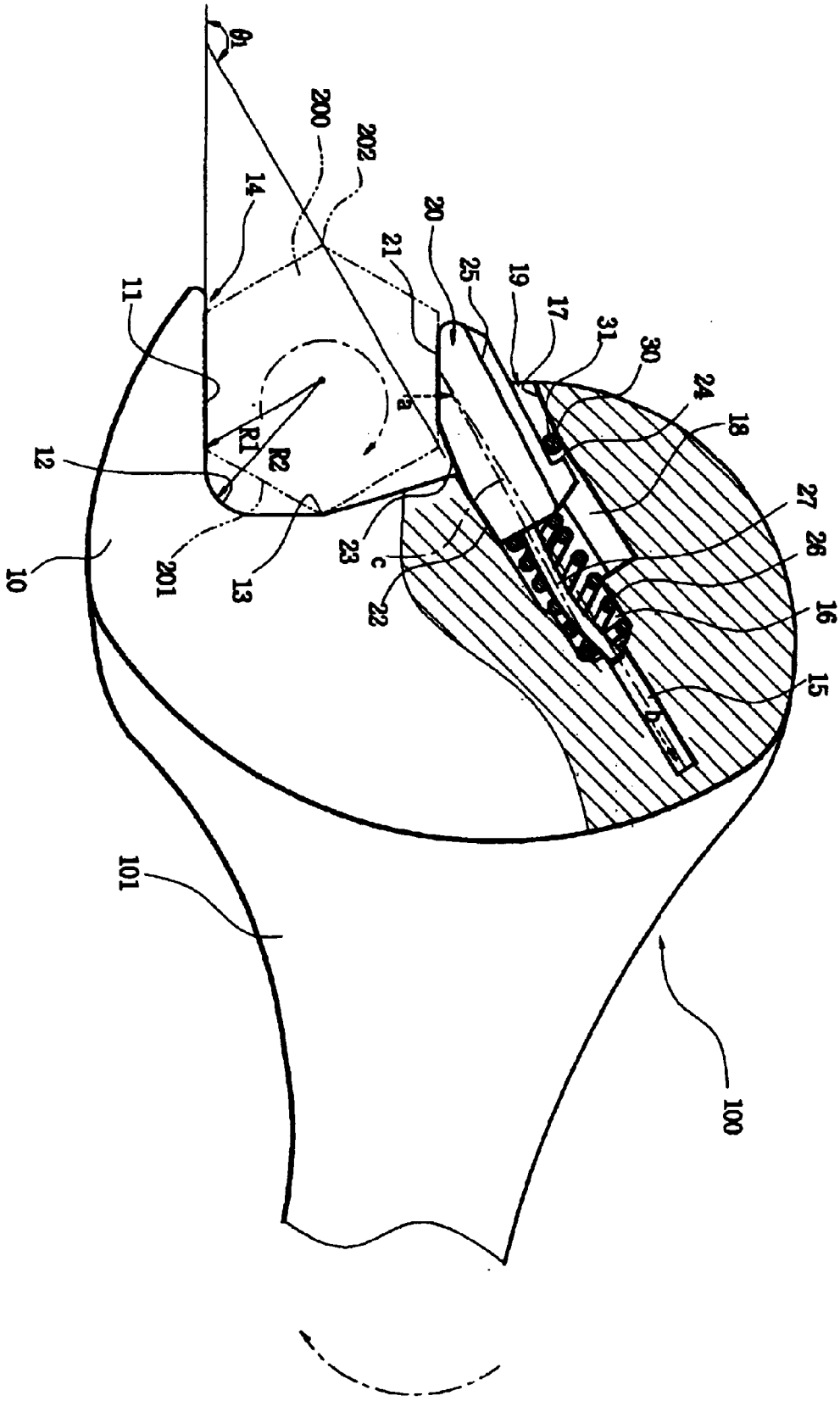

[Fig4]
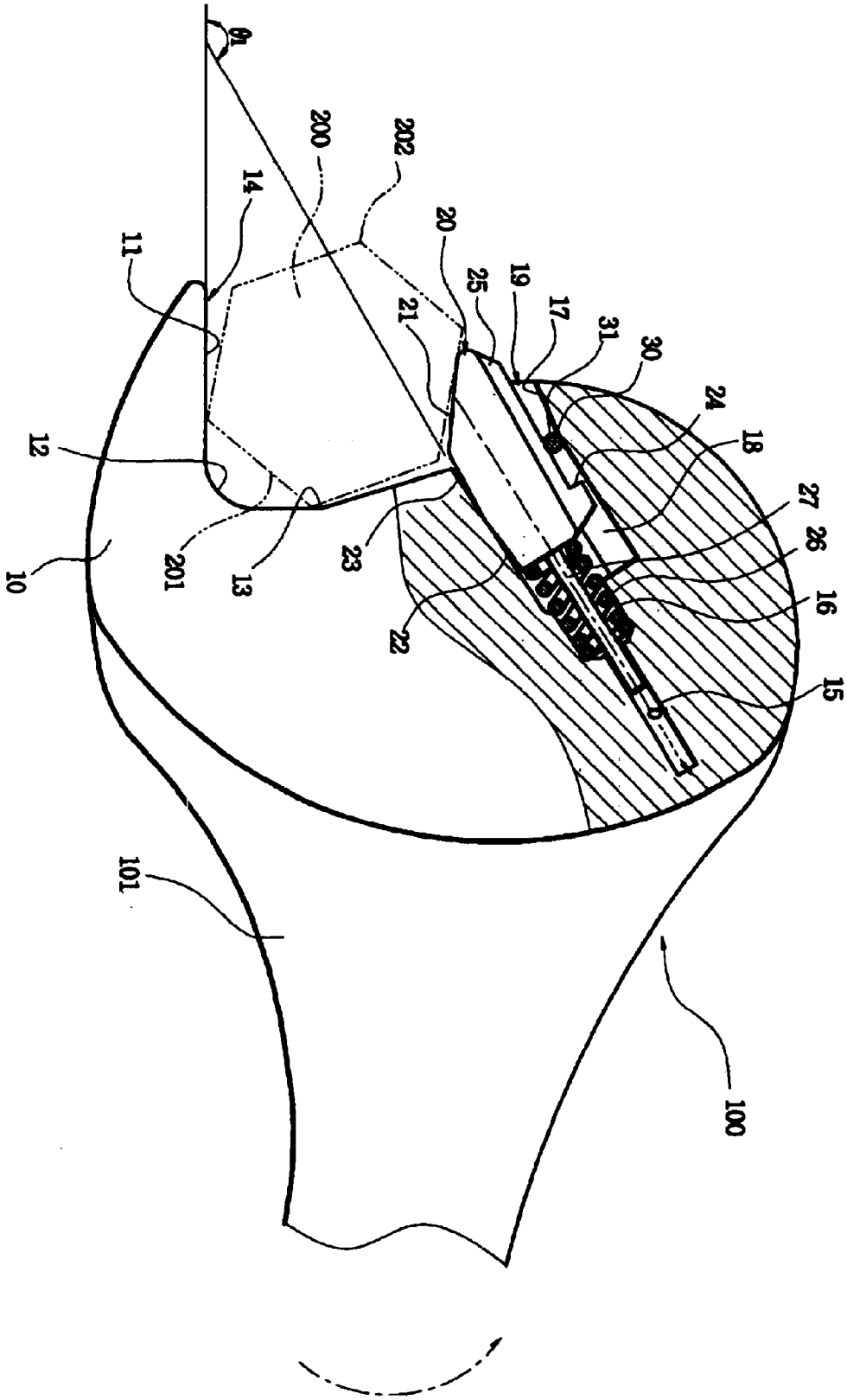

[Fig5]
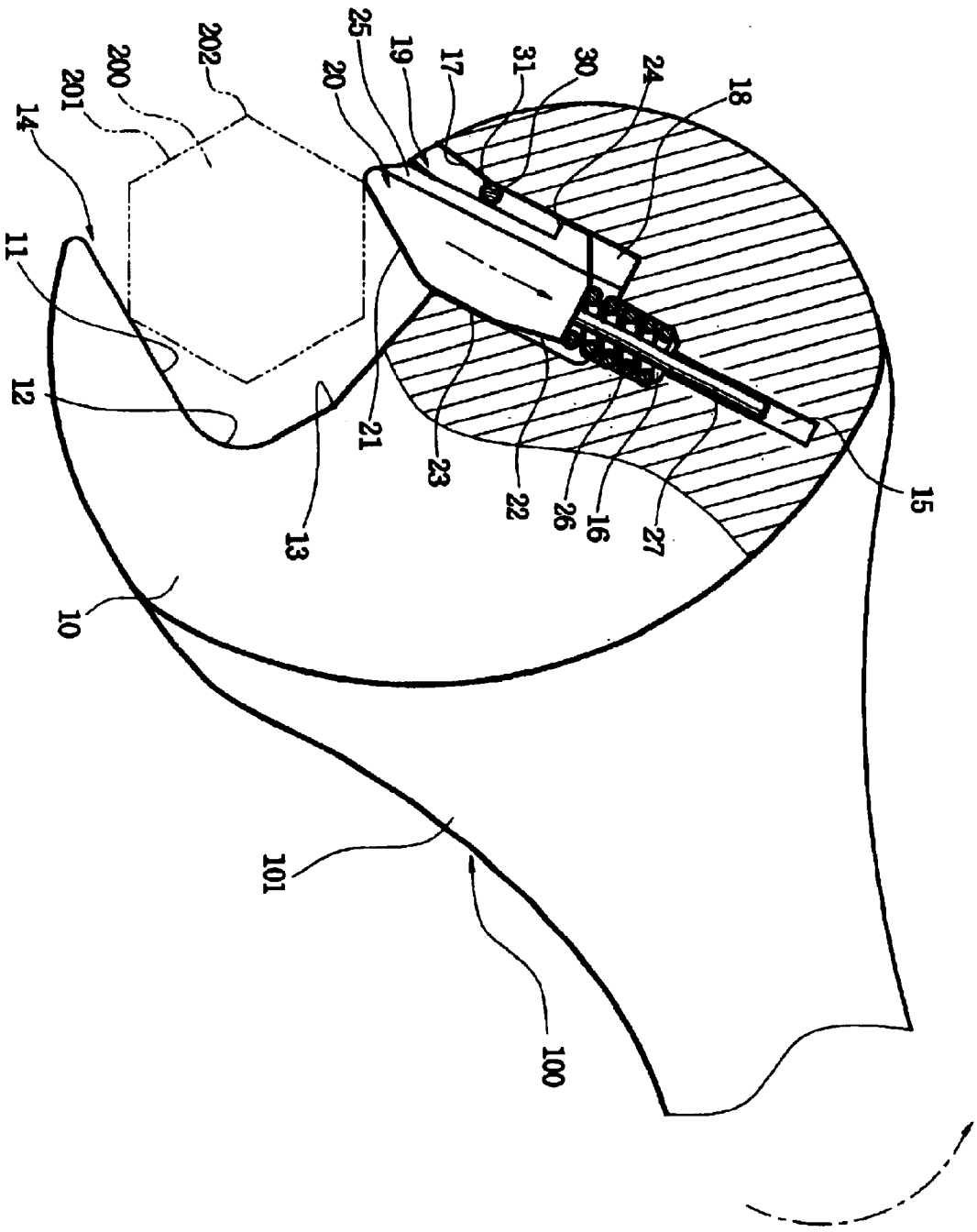

[Fig6]
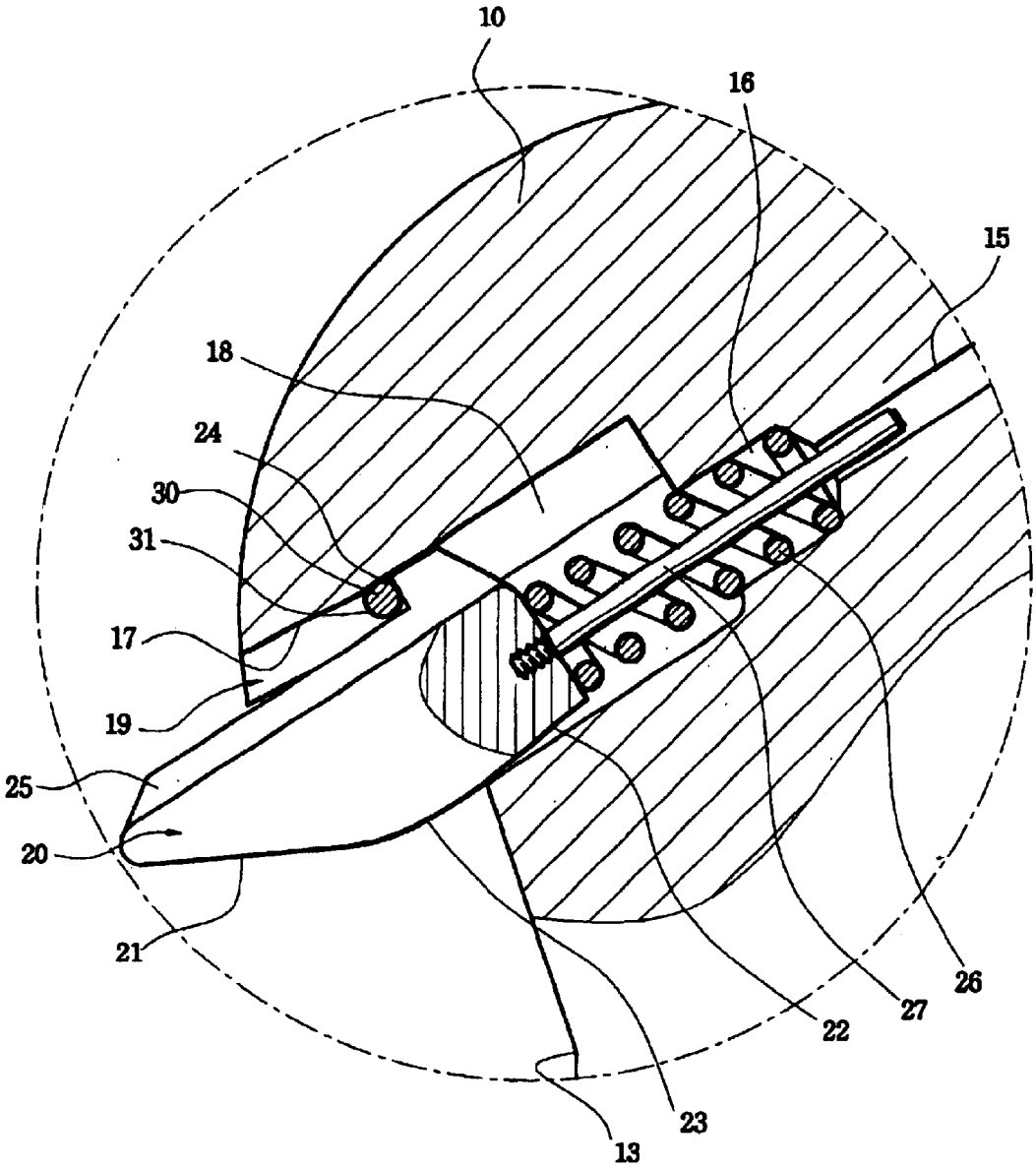

SELF-ADJUSTABLE UNIVERSAL SPANNER

BACKGROUND OF THE INVENTION

1. Field of the Invention

The present invention relates to a self-adjustable universal spanner which may fasten or loosen a bolt or nut simply, continuously and efficiently without the spanner head being deviated from the bolt or nut, by rotating the bolt or nut just one direction when the spanner head is repeatedly rotated clockwise and counterclockwise direction, such as a ratchet spanner, with the head being combined with the hexagonal head of the bolt or nut. And the invention may be applied to bolts or nuts having hexagonal heads of several adjoining dimensions.

More specifically, the present invention relates to a self-adjustable universal spanner which is comprised of: a spanner head member having a jaw means for seating a bolt head and a feed groove means, wherein the jaw means includes the flat contact surface which is in surface contact with the flat surface of the bolt head in the front lower of the jaw means, and includes an escape curved surface and a slope surface for vertex contact in the rear of the flat contact surface, wherein the feed groove means includes a spring insert groove with a pin escape groove being installed in the rear thereof and includes a guide groove for deviation prevention with a escape slope surface being installed in the tip thereof; a brake piece member having a slope contact surface, a slope surface for slip prevention, a guide protrusion and a elastic support pin, wherein the slope contact surface is formed in the tip of the member, and the contact surface for slip prevention is formed in the rear bottom of the flat contact surface, and the guide protrusion has a deviation preventing shoulder protrusively installed in the length direction, and the support pin is provided in the rear of the member, wherein the member is slidably inserted in the feed groove means of the spanner head; and a deviation preventing pin which keeps the brake piece member from deviating by being inserted in front of the guide groove for deviation prevention. Thus, using the invention, the bolt or nut may be loosened or fastened continuously by rotating the spanner head member clockwise and counterclockwise with only one combining work without the spanner head being detached from or in contact with the bolt head.

2. Description of the Prior Art

In general, when making use of a common spanner for fastening and loosening a bolt or nut having a hexagonal head, a bolt or nut may be fastened and loosened by rotating the handle of the spanner in one direction. Thus, whenever rotated using said spanner, a bolt or nut has to be detached from the spanner head combined with the hexagonal head thereof. Thereafter, the combining position is adjusted and the work is repeated which fits and rotates the bolt or nut. As mentioned above, there are inconveniences in use. Since most of sizes of the bolt insert grooves in the spanner heads are fixed according to the sizes of the bolt head or nut, the spanner which corresponds to the size of the bolt head or nut must be prepared so that the preparation or use of the spanner occurs to be inconvenient. When, in the same work position, the spanner is applied and used to several adjoining dimensions of the bolt heads and nuts, each spanner which corresponds to each size has to be replaced and used. Therefore, there are inconveniences and troubles of preparing and replacing with several sizes of spanners at work and so on.

And, There is a spanner, so called a monkey spanner, which may adjust the size of the spanner according to that of the bolt head or nut. This spanner has an advantage to be made use of without limitation of the size of the bolt head. However, since the work for detaching and combining the spanner head from the bolt head or nut has to also be repeated at every fastening or loosening work of the bolt, the use of such a spanner has an inconvenient demerit like a common spanner. In use, since this spanner makes a problem that a gap between a fixed jaw and a movable jaw is changed with ease, the gap has to be readjusted with frequency.

Therefore, in order to solve the inconveniences and demerits mentioned above, it has usually been prevailed that a hexagonal bolt head or nut is fastened or loosened with the spanner repeating the clockwise and counterclockwise rotation just like the ratchet type. However, since it is made up of ratchet gears and many complicated parts, the manufacturing cost is increased so that customer gets to feel an economic burden. When the structural vulnerableness emerges into a problem by handling negligence in use, the spanner is easily out of order. Since the size of socket combined with a hexagonal bolt head or nut has already been standardized and fixed, it is of inconvenience that the socket has to be replaced to use according to the head size of the hexagonal bolt or nut. And, since it is apprehended that the socket disassembled would be lost, user has to pay attention to its treatment. In case of the bolt with a distorted head, since the socket of the spanner is not fitted to the bolt head, such a spanner can't be used to the hexagonal bolt or nut with a distorted head. As mentioned above, there are several problems in use of such a spanner.

To consider such problems, the spanner invented by the present inventor has been patented to U.S. Pat. No. 6,202,516 and U.S. Pat. No. 5,579,667 and so on, wherein said spanner may be applied uniformly to several sizes of hexagonal bolts or nuts having a fine difference of dimension. However in case of U.S. Pat. No. 6,202,516, the movable piece of the brake member is slidably installed with a spring by passing through the pin insert hole in the rear of the cut-off groove formed in the spanner head, and then passing through the screw, and ⊏ typed move preventing piece is combined with and fixed to the pin. Thus, it is difficult and hard to machine the head, which becomes an economic burden to increase in the manufacturing cost. Since ⊏ typed move preventing piece is exposed outside of the head, there is a vulnerable problem in terms of durability. And, in case of U.S. Pat. No. 5,579,667, in spite of the stability of its function, the whole construction is complicated so that the manufacturing cost is high, which restricts its mass production.

SUMMARY OF THE INVENTION

Therefore, it is an object of the invention to provide a spanner for self-adjusting the fine dimension, which may easily be applied to several sized bolts or nuts with hexagonal heads having fine and adjoining dimensions using a one spanner by resolving overall defects and demerits of above common spanners and ratchet spanner and by improving the structures of said US patents applied by the inventor.

It is a further object of the invention to provide a spanner which may fasten or loosen a bolt or nut by rotating the bolt or nut just one direction by the rotation of the spanner clockwise and counterclockwise directions with the spanner being combined with the hexagonal head, without any work of the spanner being detached from and combined with the hexagonal head, when the hexagonal head of the bolt or nut is fastened or loosened.

It is a still further object of the invention to provide a spanner which may improve the efficiency of work by having the spanner be slipped and idled in the movement of the spanner to the work position for combination and by having the spanner not be idled in rotation of the spanner for fastening or loosening the bolt or nut, when the bolt head or nut is fastened or loosened.

It is a still further object of the invention to provide a spanner of which structure is simplified so that there is no concern about a mechanical trouble and which may easily be assembled and manufactured, so as to have common home as well as industrial field make use of ratchet type spanner easily and economically by cheaply supplying with the spanner for self-adjusting the fine dimensions of several sizes.

These and other objects of the invention are achieved by providing a self-adjustable universal spanner comprising: a spanner head member having a jaw means for seating a bolt head and a feed groove means, wherein the jaw means includes the flat contact surface which is in surface contact with the flat surface of the bolt head in the front lower of the jaw means, and includes an escape curved surface and a slope surface for vertex contact in the rear of the flat contact surface, wherein the feed groove means includes a spring insert groove with a pin escape groove being installed in the rear thereof and includes a guide groove for deviation prevention with a escape slope surface being installed in the tip thereof; a brake piece member having a slope contact surface, a slope surface for slip prevention, a guide protrusion and a elastic support pin, wherein the slope contact surface is formed in the tip of the member, and the contact surface for slip prevention is formed in the rear bottom of the flat contact surface, and the guide protrusion has a deviation preventing shoulder protrusively installed in the length direction, and the support pin is provided in the rear of the member, wherein the member is slidably inserted in the feed groove means of the spanner head; and a deviation preventing pin which keeps the brake piece member from deviating by being inserted in front of the guide groove for deviation prevention.

BRIEF DESCRIPTIONS OF THE DRAWINGS

The above and other objects, features and other advantages of the present invention will be more clearly understood from the following detailed description taken in conjunction with the accompanying drawings, in which;

FIG. 1 is an exploded perspective view of the main part of the present invention with a spanner handle being cut off partially;

FIG. 2 is a side view of the present invention having a partially sectional portion before combination;

FIG. 3 is a clockwise operational drawing of the spanner head having a partially sectional view thereof in a state of the bolt rotating operation;

FIGS. 4 and 5 are counterclockwise operational drawings of the spanner head having a partial sectional view thereof with the bolt rotating operation stopped; and FIG. 6 is an enlarged view of the part A in FIG. 2.

DETAILED DESCRIPTION OF THE PREFERRED EMBODIMENT

FIG. 1 is an exploded perspective view of the main part of the present invention with a spanner handle being cut off partially, FIG. 2 is a side view of the present invention having a partially sectional portion before combination, FIG. 3 is a clockwise operational drawing of the spanner head having a partially sectional view thereof in a state of the bolt rotating operation, FIGS. 4 and 5 are counterclockwise operational drawings of the spanner head having a partial sectional view thereof with the bolt rotating operation stopped, and FIG. 6 is an enlarged view of the part A in FIG. 2.

As shown in the drawings, the spanner 100 of the invention is provided with a spanner head member 10 combined with a hexagon bolt head 200, and a handle 101, and the bolt head 200 is generally formed with 6 flat surfaces 201 and 6 vertexes 202.

The spanner head member 10 is provided with a flat contact surface 11 which is in surface contact with the flat surface 201 of the bolt head 200 in the front lower portion thereof. The rear portion in the bolt head 200 is provided with the circular arc shaped escape curved surface 12 which is out of contact with the vertex 202 in the bolt head 200, and the jaw means 14 for seating the bolt head in which the sloped surface 13 is continuously formed, which surface comes into contact with the vertex 200. And in the straightly upper part of the sloped surface 13 in the jaw means 14, a feed groove means 19 is installed to the flat contact surface 11 at a predetermined angle $\theta_1$ upward and slopingly. The feed groove means 19 includes a pin escape groove 15 and a spring insert groove 16 which are installed in turn in the rear part thereof, and a guide groove 18 for deviation prevention having escape sloped surface 17 in the tip of means 19. In the front upper part in the guide groove 18, a pin hole 31 is installed which may insert and fix a escape preventing pin 30 for preventing the deviation of a brake piece member 20 as will be mentioned below.

And, the escape surface 12 formed in the rear portion of the flat contact surface 11 of said jaw means 14 is positioned in circular arc shape at a distance R2 longer than a distance from the center O of the bolt head 200 to the vertex 202. The vertex 202 of the bolt head may move in a state of not contacting and colliding with the rear escape surface 12 of the jaw means 14 when the spanner head member 10 and the vertex 202 are combined and worked with each other. Then, the flat contact surface 11 in the spanner head member 10 may be in smooth contacted with the hexagonal flat surface 201 and the vertex 202 under unloaded condition when the spanner head member 10 is idling with the bolt head 200 being combined with and fixed to the spanner head member 10. Therefore, the spanner head member 10 may get to be worked smoothly. The brake piece member 20 is slidably inserted in said feed groove means 19 in front and in the rear.

The brake piece member 20 is provided with the sloped contact surface 21 which is formed with slope and in surface contact with the flat surface 201 of the bolt head 200 in the bottom and tip portion thereof. The flat surface 23 is formed with slope with the sloped surface 22 being shaped at a predetermined angle in the rear of the slope contact surface 21. The guide protrusion 25 is protruded in the longitudinal direction in the upper surface of the member and has the escape preventing shoulder 24 protruded in the rear portion thereof. The elastic support pin 27, for example a piano steel wire, is screw combined with the member 20 with a spring 26 being interposed between. The brake piece member 20 combined is installed slidably and elastically in the feed groove means 19 of said spanner head member 10 and the deviation preventing pin 30 is inserted into the pin hole 31 formed in front of the guide groove 18 for the prevention of deviation. Thus, this structure prevents the brake piece member 20 from deviating.

It is desirable that the slope angle $\theta_1$ of said feed groove means 19 should be formed in the range of 147°±3° to the flat contact surface 11 in the jaw means 14. And it is more desirable that the slope angle $\theta_1$ of the slope contact surface 21 should be formed at 147 degrees.

When the brake piece member 20 is combined and operated with the bolt head 200 with the slope angle $\theta_1$ of the feed groove means 19 being less than 144°, it is advantageous that, when the brake piece member 20 is in contact with the flat surface 210 or the vertex 202 of the bolt head 200, the lift operation of the brake piece member 20 gets to be soft and smooth by the brake piece member 20 being pushed back. However, in operation, the lift operation is unsafe since the bolt head 200 may not be braked completely. When the slope angle $\theta_1$ of the feed groove means 19 is greater than 150°, contrary to the above operation, the brake piece member 20 may surely brake the bolt head 200. However, it is difficult that the brake piece member 20 gets pushed back interior of the feed groove means 19. The size range for the application of the bolt head 200 is narrow and the head 200 can't help being used with limitation. Thus it is preferable that the slope angle $\theta_1$ should be at 147 degrees.

The present invention may be constructed and operated as follows. The support pin 27 is screw-combined with the rear end of the brake piece member 20. After the spring 26 is inserted in the periphery of the elastic support pin 27, the brake piece member 20 may be inserted in the feed groove means 19 with the upper guide protrusion 27 and the escape preventing shoulder 24 of the member 20 being guided into the upper guide groove 18 in the feed groove means 19. Then, the escape preventing pin 30 is inserted and sealed into the pin hole 31 formed in front of the guide groove 18 and the assembly of the invention is over. At this time, when the guide protrusion 25 in the upper surface of the brake piece member 20 is guided and inserted interior of the guide groove 18 in the feed groove means 19, the slidable in and out operation of the member 20 can surely be accomplished since the brake piece member 20 is firmly supported without any pitch and roll. And, since the spring 26, fitted to rear elastic support pin 27 in the member 20, remains firmly closed and inserted into rear spring insert groove 16 in the feed groove means 19, the brake piece member 20 can be operated surely and elastically without any pitch and roll, and any slip.

The operation of the invention mentioned above is explained by using FIG. 2 to FIG. 5 more in detail.

FIG. 2 is a side view of the present invention just before the spanner 100 is combined with a hexagonal bolt head 200. As the bolt head 200 advances into the spanner 100 without regard to the position of the bolt head 200 for combining with the flat contact surface 11 of the jaw means 14 in lower front of the spanner head member 10, the upper part of the bolt head 200 advances with being in contact with the tip jaw having a gentle curve in the tip of the member 20 and the member 20 is pushed back.

In this state, as illustrated in FIG. 3, any one part of the hexagonal flat surfaces 201 and vertexes 202 corresponds to and is in surface contact with the flat surface 11 in the jaw means 14 by rotating the handle 101 of the spanner 100 according to the arrow (clockwise) direction and then rotating the jaw means 14 in the spanner head member 10. The brake piece member 20 retracted in rear of the feed groove means 18 advances with elasticity of the spring 26, and the lower sloped contact surface 21 in the member 20 becomes in surface contact with the flat surface 201 in the opposed part thereof. At this time, as the sloped contact surface 21 in the lower of the member 20 is in contact with the flat surface 201 in the bolt head 200, and the sloped surface 22 for slip contact in the rear of the member 20 is in contact with feed groove means 18, the elastic support pin 27 installed in the rear of the brake piece member 20 is bent under elasticity. Thus, the sloped contact surface 21 side of the member 20 is more closely combined with the flat surface 201 of the bolt head 200 with the enhancement of the grip force of the bolt head 200. In this state, as the handle 101 is rotated in the arrow (clockwise) direction, the stress to the rotational direction is produced with both flat surfaces 201 in the bolt head 200 being firmly fitted between the flat surface 11 in the jaw means 14 and the parallelly opposed slope contact surface 21 in the brake piece member 20, then rotates the bolt head 200 so as to loosen or tighten it. Therefore, in the brake piece member 20, the stress is produced by receiving force with the guide protrusion 25 being combined with the guide groove 18 in the feed groove means 28. And, the rotational force by the rotation of the flat surface 201 in the bolt head 200 by rotating the spanner head member 10, acts on the sloped contact surface 21 in surface contact with the surface 201 each other, and then pushes up the flat contact surface 11 in the member 20 toward the dotted arrow a direction. Thus, by the action of the force which pushes up the whole brake piece member 20 toward the dotted arrow b direction in the rear of the feed groove means 18, the flat contact surface 11 side of the member 20 is primarily lifted up by the escape sloped surface 17 formed at a predetermined angle in the rear of the flat surface 23 of the bottom of the member 20. Then the tip portion of the sloped contact surface 21 of the member 20 is lifted toward the escape sloped surface 17 side. As the sloped surface 22 in the end of the lower flat surface 23 of the member 20 is in contact with the bottom of the feed groove means 19 and is displaced, the center line c of the brake piece member 20 is biased to the dotted arrow b. As a result, the bolt head 200 is surely loosened or fastened by the member 20 being fixed without any slip.

With the bolt head 200 being loosened or fastened by rotating the handle 101 of the spanner 100 at a predetermined angle, as illustrated in FIG. 4, when the handle 101 of the spanner 100 is rotated reversely in the arrow (counterclockwise) direction, the brake piece member 20 is pushed back with the lower sloped contact surface 21 in the member 20 moving toward the hexagonal flat surface 201 and the vertex 202 of the bolt head 200. And, the spanner 100 idles by the brake piece member 20 pressing and pushing back the spring 26. In an instant of the slope contact surface 21 passing over the vertex 202 in the bolt head 200, the brake piece member 20 advances by the elastic force of the spring 26 again and the flat contact surface 11 is positioned like location of FIG. 3. Thus, since the flat slope surface 11 is in surface contact with the flat surface 201 in the bolt head 200 again, the invention operates in the same state as the illustration of FIG. 3. The spanner 100 is not escaped from the bolt head 200. And, the hexagonal bolts or nuts may be fastened or loosened by intermittently and repeatedly rotating like a ratchet spanner just by using of clockwise and counterclockwise rotation of the spanner 100.

As described above, the present invention is simply comprised of the spanner head having the feed groove means including a pin escape groove, a spring insert groove and a guide groove for deviation prevention formed therein; the brake piece member having a deviation preventing shoulder and a guide protrusion formed therein; and the pin for preventing the brake piece member from deviating. Therefore, the invention may provides with a spanner of which structure is simplified so that there is no concern about a mechanical trouble and which may easily be assembled and manufactured, so as to cheaply supply with the ratchet type spanner for self-adjusting the fine dimensions of several sizes. The strength of the brake piece member may be firmed by forming the guide protrusion therein, and the strength and durability of the spanner may be improved remarkably without any pitch and roll in operation.

Although the preferred embodiments of the present invention has been disclosed for illustrative purpose, those skilled in the art will appreciate that various modifications, additions and substitutions are possible, without departing from the scope and spirit of the invention as disclosed in the accompanying claims.

What is claimed is:

1. A self-adjustable universal spanner comprising:

a spanner head member and a brake piece having the same width as said spanner head member and operatively connected thereto, said spanner head member including a jaw portion for seating a bolt head and an open slot formed in the jaw portion, wherein the jaw portion includes a flat surface formed in the front lower thereof, and wherein the open slot includes a pin escape groove in a base thereof and a spring insert groove formed in the rear upper side of the jaw portion, and a guide groove for deviation prevention formed in the upper wall of the open slot;

said brake piece member having a sloped contact surface, a guide protrusion of a width less than a width of said brake piece member, and a elastic support pin, wherein the sloped contact surface is formed in the tip bottom of said brake piece member, and the guide protrusion is provided with an escape preventing shoulder formed protrusively thereon, and the elastic support pin is installed in the rear end of the brake piece member, and wherein the brake piece member is slidably inserted in the open slot of the spanner head member such that the guide protrusion fits within the guide groove of the open slot; and a deviation preventing pin, wherein the deviation preventing pin limits an extension of the brake piece member upon insertion in the front pin hole of the guide groove.

2. A self-adjustable universal spanner according to claim 1, wherein the brake piece member is provided with the sloped contact surface downwardly sloped at a predetermined angle, a flat surface, and a sloped slip preventing surface oppositely tapered with respect to the sloped contact surface, which are formed in order from the tip bottom thereof.

3. A self-adjustable universal spanner according to claim 1, wherein the slope angle $\theta_1$ of the open slot in the spanner head member is set in the range of 147°±3° to the flat contact surface.

4. A self-adjustable universal spanner comprising:

a head member; and a brake piece operatively connected to said head member, said head member including a jaw portion defining an inner bolt seating surface and having a lower jaw leg of a greater length than an opposing upper jaw leg, the inner bolt seating surface of the lower jaw leg defining a flat surface substantially parallel to a longitudinal axis of a spanner handle, a brake slot, formed in connection with the upper jaw leg, for slidably receiving said brake piece, a guide groove formed in an upper side wall of said brake slot, the guide groove and brake slot defining a distinct predetermined slope at an open end of the brake slot with respect to a remaining upper side wall surface of the guide groove and brake slot, a spring insert formed in an end wall of said brake slot and a pin insert formed in an end of the spring insert, the pin insert having a smaller diameter than the spring insert, and means, traversing the guide groove, for limiting extension of said brake piece with respect to the upper jaw leg;

said brake piece including a bolt contact surface facing the flat surface of the lower jaw leg, a guide surface facing the guide groove of the upper jaw, said guide surfacing including a brake stiffening member protruding therefrom and bounded by a limiting shoulder adjacent a lower portion of the guide surface, and an elastic support pin fixed to a base end of said brake piece and a spring member surrounding the elastic support pin, said elastic support pin urging said brake piece in a direction of the lower jaw when said brake piece is operative, wherein a said brake piece is extensible from said brake slot to a position where the limiting shoulder abuts the means for limiting extension of said brake piece, and wherein at least a portion of said brake piece extends above a height of said brake slot under compression of the spring member.

5. The self-adjustable universal spanner according to claim 4, wherein the stiffening protrusion of said brake piece mates with the guide groove of the brake slot, thereby preventing lateral deviation of said brake piece within said brake slot.

6. The self-adjustable universal spanner according to claim 4, wherein said means for limiting extension of said brake piece includes a pin traversing the guide groove.

7. The self-adjustable universal spanner according to claim 6, wherein the pin is positioned to traverse the guide groove adjacent a transition to the predetermined slope at the open end of the brake slot.

8. The self-adjustable universal spanner according to claim 4, wherein the predetermined slope is only at the open end of the brake slot.

9. The self-adjustable universal spanner according to claim 4, wherein the predetermined slope is in the range of 147°±3° with respect to the flat surface of the lower jaw leg.

10. The self-adjustable universal spanner according to claim 4, wherein the bolt contact surface is angled from a flat surface of said brake piece to join at a rounded outer tip with the guide surface of said brake piece.

11. The self-adjustable universal spanner according to claim 10, wherein the brake piece further includes a slip preventing surface tapering from an opposing end of the flat surface from the bolt contact surface.

12. The self-adjustable universal spanner according to claim 4, wherein the sloped surface of the slot in combination with the elastic support pin and dimension of said brake piece enables non-slip engagement of a bolt head.

* * * * *